United States Patent [19]

Mirabella

[11] Patent Number: 4,503,004

[45] Date of Patent: Mar. 5, 1985

[54] METHOD OF MOLDING A RED PHOSPHOROUS PYROTECHNIC COMPOSITION

[75] Inventor: Peter D. Mirabella, Bel Air, Md.

[73] Assignee: The United States of America as represented by the Secretary of the Army, Washington, D.C.

[21] Appl. No.: 588,827

[22] Filed: Mar. 12, 1984

[51] Int. Cl.[3] ..... C06B 45/10

[52] U.S. Cl. ..... 264/3 R; 102/334; 149/19.6; 149/19.92; 149/29; 149/31; 149/117

[58] Field of Search ..... 149/29, 31, 19.6, 117, 149/19.92; 264/3 R, 3 B; 102/334

[56] References Cited

U.S. PATENT DOCUMENTS

| | | | |
|---|---|---|---|
| 2,574,466 | 11/1951 | Clay et al. | 149/117 |
| 2,635,953 | 4/1953 | Silverstein et al. | 149/31 |
| 3,184,352 | 5/1965 | Baker | 264/3 R |
| 3,650,856 | 3/1972 | Artz | 149/117 |
| 3,733,223 | 5/1973 | Lohkamp | 149/19.6 |
| 3,985,592 | 10/1976 | Hackett et al. | 149/15 |
| 4,032,374 | 6/1977 | Doada et al. | 149/117 |
| 4,099,376 | 7/1978 | Japs | 149/19.4 |
| 4,112,036 | 9/1978 | Woodhams et al. | 264/28 |
| 4,124,418 | 11/1978 | Reed et al. | 149/19.4 |
| 4,151,233 | 4/1979 | Fry | 149/29 |
| 4,184,901 | 1/1980 | Tanner et al. | 149/117 |
| 4,238,254 | 12/1980 | Prähauser et al. | 149/29 |
| 4,428,786 | 1/1984 | Arni | 149/21 |

*Primary Examiner*—Edward A. Miller

*Attorney, Agent, or Firm*—Anthony T. Lane; Robert P. Gibson; Edward F. Costigan

[57] ABSTRACT

A method of molding a red phosphorous pyrotechnic mix containing an epoxy binder, which is markedly improved by the addition of silica.

8 Claims, No Drawings

METHOD OF MOLDING A RED PHOSPHOROUS PYROTECHNIC COMPOSITION

GOVERNMENTAL INTEREST

The invention described herein may be manufactured, used and licensed by or for the Govenment for Governmental purposes without payment to me of any royalties thereon.

BACKGROUND OF INVENTION

1. Field of Use:

This invention relates to a pyrotechnic composition having improved flow properties which make it adaptable advantageously to processing on an automatic basis without the hazards of the art relative operating personnel.

More particularly, this invention relates to an improved free-flowing smoke-producing chemical mixture which may be consolidated into a unitary solid tablet on an automatic basis in a substantially less hazardous manner relative operating personnel.

2. Description of Prior Art

Smoke-producing pyrotechnics are hazardous to produce, and much of the conventional procedures used to produce such compositions are carried out on a manual basis. The compositions containing red phosphorous are especially sensitive to flame, spark, static electricity and temperature and may produce deflagration or be ignited into flames during the consolidation procedure when the chemical mixture is reduced to a unitary solid tablet for use in the 81MM mortar shell. As a result of the blending procedure the three main ingredients of the smoke-producing composition, namely red phosphorous, sodium nitrate, and a binder are mixed with acetone to make blending easier. When the acetone is evaporated, a damp, tacky mix is produced for use in the consolidating procedure. From this point in processing, the mix is consolidated into a solid tablet. The conventional procedure of consolidation requires the operating personnel to weigh the pyrotechnic mix into cups, pour the pyrotechnic charge into the mold of a press, actuate the press, release the press, remove the mold from the press, separate the consolidated tablet from the mold, and clean the mold. In actual practice, the best production rate of the consolidating procedure is one tablet per minute. Up to the present time, there are no known devices, systems or processes which would allow production of the cited pyrotechnic into consolidated unitary tablet in other than the above eight-step manual operation.

The basic reason for the use of operating personnel in the cited consolidation process is the resulting physical state of the pyrotechnic composition after the blending stage of the process. The composition is sticky and tacky much like an epoxy glue and the only way it may be handled is manually. However, the pyrotechnic mix is extremely sensitive, and the procedure has demonstrated extreme hazards to operating personnel who are in proximity to such mix during the consolidating stage of processing.

What is needed in the art is an improved composition which would allow the production of consolidated tablets of the cited pyrotechnic in an automatic manner without the hazards of the art relative operating personnel.

SUMMARY OF INVENTION

It is therefore an object of this invention to provide an improved smoke-producing pyrotechnic mixture or composition which may be processed in a relatively safe manner on automatic equipment.

Another object is to provide an additive which may be used to produce a free-flowing, smoke-producing pyrotechnic composition or mixture which may be processed on automatic equipment in a relatively less hazardous manner relative operating personnel.

A further object is to provide an additive which may be used to produce a consolidated unitary tablet from an improved pyrotechnic composition in a more effective and more highly efficient manner for use in the 81MM mortar shell.

Other objects and many of the attendant advantages of this invention will become more apparent to those skilled in the art from a reading of the more detailed description which follows.

In general, the invention consists essentially of adding either fumed silica, colloidal silica, pyrogenic silica, amorphous silica, or synthetic silica to the red phosphorous smoke-producing composition without affecting the primary use of the composition as a smoke-producing mix for military use. The silica, otherwise known as silicone dioxide, is blended into the composition as a coating on granules of the composition which consists essentially of red phosphorous, sodium nitrate, and the epoxy binder, in an amount of about 1 percent by weight based on the weight of the composition. It has been found that the pyrotechnic granular composition is then less tacky or sticky and advantageously free flowing and may be consolidated into unitary tablets on automatic presses in a more effective and efficient manner. The resulting demonstrated rate has been increased to about 20 solidified tablets per minute. This is a 2000 percent increase in efficiency and is accomplished without the hazards associated with manual handling of the pyrotechnic formulation.

DESCRIPTION OF PREFERRED EMBODIMENT

The acetone utilized during the cited blending operation was allowed to substantially evaporate. The resulting mixture was a sticky or tacky granular mass and the pyrotechnic composition would not flow to the mold or cavity of the press. Fumed slica or silica dioxide by the trade name of Cab-O-Sil was then added or blended into the tacky mass or composition in an amount of about 1 percent by weight based on the weight of the tacky pyrotechnic mass.

At this point, the free-flowing pyrotechnic granular mass or mixture was fed to a hopper, the feed chute was directed to the cavity of the press where it was subjected to 12,000 pounds per square inch for a dwell time of about one second. The consolidating process was carried on continuously to produce as many as 1958 tablets at a continuous production rate of about 20 tablets per minute. Thus the efficiency is increased 2000 percent, and the result is highly effective because the resulting tablet may still be used in the 81MM mortar shell for the desired purpose of producing a smokescreen.

The fumed silica, otherwise known as fumed silicon dioxide, may be added to the pyrotechnic mix of red phosphorous, sodium nitrate, and epoxy binder in an amount between about 0.5 percent and 2.0 percent by weight based on the weight of the pyrotechnic mix. If an amount below 0.5 percent is added to the pyrotechnic composition, the flow-properties of the mix are not as dramatic as desired. However, if the silica is added in an amount greater than 2.0 percent, the smoke-producing properties of the pyrotechnic mix are generally adversely affected. The preferred amount of silica to be added to the pyrotechnic mix for free-flowing processing is about 1 percent by weight. It has been found that the pyrotechnic mix is free-flowing and may be effectively and efficiently processed on an automatic press.

The press that is used in the processing of the cited pyrotechnic mix into a plurality of consolidated tablets is a conventional Stokes Mechanical Press. The press is provided with an automatic hopper which is directed by means of a feed chute to a cavity whch is adapted with an upper and lower ram. The free-flowing pyrotechnic composition is added to the hopper and automatically fed to the mold-like cavity. When the required amount is received by the mold-like cavity, it is closed and the upper and lower ram apply a pressure of 12,000 pounds per square inch to the pyrotechnic mix in the cavity for a dwell time of about one second. In this manner, a unitary consolidated tablet is effectively produced in a continuous manner at a highly efficient rate of production. The entire consolidation process is accomplished automatically, and there is no need for operating personnel in the area proximate the press during the feed, flow, or press stages of the procedure.

I claim:

1. In an improved process of consolidating a pyrotechnic mix into a unitary tablet on a substantially less hazardous basis, said pyrotechnic mix consisting essentially of red phosphorous, sodium nitrate, and an epoxy binder, the improvement comprising adding silica to said pyrotechnic mix, automatically feeding said pyrotechnic mix to a mold, and automatically subjecting said molded pyrotechnic mix to a pressure of about 12,000 pounds per square inch for a dwell time of one second.

2. The process of claim 1 wherein said silica is added to said pyrotechnic mix in an amount between about 0.5 and 2.0 percent by weight based on the weight of said mix.

3. The process of claim 1 wherein said silica is added to said pyrotechnic mix in an amount up to about 1 percent by weight based on the weight of said mix.

4. The process of claim 3 wherein said silica is fumed.

5. The process of claim 3 wherein said silica is colloidal.

6. The process of claim 3 wherein said silica is pyrogenic.

7. The process of claim 3 wherein said silica is amorphous.

8. The process of claim 1 wherein said silica is synthetic.

* * * * *